US005144998A

United States Patent [19]

Hirai et al.

[11] Patent Number: 5,144,998

[45] Date of Patent: Sep. 8, 1992

[54] PROCESS FOR THE PRODUCTION OF SEMI-SOLIDIFIED METAL COMPOSITION

[75] Inventors: Masazumi Hirai; Katsuhiro Takebayashi; Ryuji Yamaguchi; Yasuo Fujikawa, all of Chiba, Japan

[73] Assignee: Rheo-Technology Ltd., Japan

[21] Appl. No.: 747,637

[22] Filed: Aug. 20, 1991

[30] Foreign Application Priority Data

Sep. 11, 1990 [JP] Japan ..... 2-2388871
Sep. 12, 1990 [JP] Japan ..... 2-240103

[51] Int. Cl.[5] ..... B22D 11/124; B22D 1/00
[52] U.S. Cl. ..... 164/71.1; 164/900
[58] Field of Search ..... 164/900, 71.1, 485

[56] References Cited

U.S. PATENT DOCUMENTS 2,225,414 12/1940 Junghans .
3,163,895 1/1965 Dewey .

FOREIGN PATENT DOCUMENTS 0095597 of 0000 European Pat. Off. .
2342112 of 0000 France .

OTHER PUBLICATIONS

"Control of the continuous rheocasting process" by M. A. Taha et al, Journal of Materials Science, vol. 23, No. 4, Apr. 1988, London GB, pp. 1379–1390.

*Primary Examiner*—Kuang Y. Lin
*Attorney, Agent, or Firm*—Austin R. Miller

[57] ABSTRACT

Semi-solidified metal compositions are stably produced by pouring molten metal into a cooling agitation vessel, agitating it while cooling to produce a slurry of semi-solidified metal composition at a solid-liquid coexistent state and discharging out the semi-solidified metal composition from a discharge port of the vessel. In this case, the cooling agitation is carried out so that a relation of fraction solid, solidification rate and shear rate satisfies the following equation (1)

$$\eta = a/2(1/f_s - 1/f_{scr}) \leqq 10 \quad (1).$$

5 Claims, 9 Drawing Sheets

PROCESS FOR THE PRODUCTION OF SEMI-SOLIDIFIED METAL COMPOSITION

BACKGROUND OF THE INVENTION

1. Field of the Invention

This invention relates to a process for stably producing a solid-liquid metal mixture in which non-dendritic primary solid particles are dispersed into the remaining liquid matrix (hereinafter referred to as a semi-solidified metal composition).

2. Disclosure of the Related Art

The term "semi-solidified metal composition" used herein means that molten metal (generally molten alloy) is vigorously agitated while cooling convert dendrites produced in the remaining liquid matrix into such a state having a spheroidal or granular shape that dendritic branches substantially eliminate or reduce (which is called as non-dendritic primary solid particles) and then disperse these primary solid particles into the liquid matrix.

As disclosed in, for example, U.S. Pat. No. 3,902,544, there is a process for the production of the semi-solidified metal composition, wherein molten metal is vigorously agitated in a cylindrical cooling agitation vessel through high rotation of an agitator while cooling to convert dendrites produced in the remaining liquid matrix into non-dendritic primary solid particles in which dendritic branches eliminate or reduce into a spheroidal or granular shape, and then these non-dendritic primary solid particles are dispersed into the liquid matrix to form a slurry of semi-solidified metal composition, which is discharged from a nozzle disposed as the bottom of the cooling agitation vessel continuously or at once every one charge of molten metal.

In the conventional process, it is known to conduct mechanical agitation using the above agitator, electromagnetic agitation electromagnetically agitating molten metal in the cooling agitation vessel and the like.

In general, the fluidity of the resulting semi-solidified metal composition is dependent upon fraction solid, increasing rate of fraction solid (represented by a ratio of solid phase metal to total volume of semi-solidified metal slurry) per unit time at solid-liquid coexistent state (hereinafter referred to as solidification rate) and average value of rate change per unit distance of the liquid matrix influenced by the agitating speed (hereinafter referred to as shear rate). In the conventional technique, therefore, it is frequently difficult to stably produce the semi-solidified metal composition because even when the fraction solid is same, the flowing of the semi-solidified metal composition is stopped in the cooling agitation vessel to cause problems such as impossibility of discharging the composition, the clogging of the discharge port with the composition and the like.

The fluidity of the semi-solidified metal composition is generally degraded as the fraction solid becomes high. When the fraction solid is not less than a certain value, usually not less than about 0.65, there are caused problems that the semi-solidified metal composition can not be discharged from the production apparatus or transferred into subsequent multi-stage production apparatus for the semi-solidified metal composition, casting device, holding device or working device to cause the stop of the flowing of the semi-solidified metal composition in the cooling agitation vessel, the impossibility of discharging the semi-solidified metal composition due to the clogging, solidification or the like.

Even when the fraction solid is not more than 65%, the fluidity becomes poor as the solidification rate is large or the shear rate is small. In other words, it is necessary that a relation of fluidity (viscosity) exerting on not only the fraction solid of the semi-solidified metal composition and solidification rate but also the shear rate is clarified in order to conduct the stable production of the semi-solidified metal composition and the stable discharge and transfer of the semi-solidified metal composition into subsequent multi-stage production apparatus, casting device, holding device and working device, whereby the agitation at a shear rate met with the fraction solid of the semi-solidified metal composition and the cooling rate or the cooling at a cooling rate met with the shear rate is conducted to properly control the fluidity.

On the other hand, when the amount of solid metal in the semi-solidified metal composition (called as fraction solid) exceeds a certain limit value due to external factors such as temperature of molten metal poured for the continuous production, discharge rate of the semi-solidified metal composition, cooling rate and the like, the viscosity of the semi-solidified metal composition rapidly increases to exhibit no fluid behavior and it is impossible to discharge the semi-solidified metal composition from the production apparatus.

In order to detect such a change of the viscosity, there has hitherto been proposed a method wherein the temperature of the semi-solidified metal composition discharged from the production apparatus is measured to estimate the fraction solid discharged, whereby the fraction solid causing the impossible discharge is controlled. In this method, there is a time lag between the cooling of molten metal and the discharge of the semi-solidified metal composition, so that it is very difficult to susceptibly control the fraction solid and hence it is difficult to stably produce the semi-solidified metal composition for a long time.

SUMMARY OF THE INVENTION

The inventors have made various experiments for producing the slurry of semi-solidified metal composition at various solidification rates under various agitating conditions and elucidated the relation among fraction solid, solidification rate and shear rate capable of ensuring the fluidity of the semi-solidified metal composition. As a result, the above problems have advantageously been solved by changing necessary shear rate and fraction solid through the agitation speed selected in accordance with the solidification rate of the semi-solidified metal composition or changing the solidification rate and fraction solid in accordance with the shear rate in order to enable the stable discharge into subsequent step.

According to the invention, there is the provision of a process for stably producing semi-solidified metal compositions by pouring molten metal into a cooling agitation vessel, agitating it while cooling to produce a slurry of semi-solidified metal composition at a solid-liquid coexistent state and discharging out the semi-solidified metal composition from a discharge port of the vessel, characterized in that the cooling agitation is carried out so that a relation of fraction solid, solidification rate and shear rate satisfies the following equation (1)

$$\eta = a/2(1/f_s - 1/f_{scr}) \leqq 10 \quad (1)$$

wherein $\eta$ is an indication value of fluidity, $a = 35000.R^{0.5}.\dot{\gamma}^{-1.7}$, $f_s$ is fraction solid of the slurry of semi-solidified metal composition, $f_{scr} > f_s$, $f_{scr} = 0.65 - 1.4.R^{\frac{1}{3}}.\dot{\gamma}^{-\frac{1}{3}}$, R is an average solidification rate in the solidification of molten metal below solidification starting temperature (liquid phase line temperature) ($\%.s^{-1}$) and $\dot{\gamma}$ is a shear rate ($s^{-1}$).

In a preferred embodiment of the invention, the cooling agitation operation is carried out by calculating an agitation torque acting to an agitator of the cooling agitation vessel from an apparent viscosity of the semi-solidified metal composition of the target fraction solid discharged according to the following formula (2) and adjusting an opening degree of the discharge valve so that a torque measured from a torque detector disposed in a rotation driving system for the agitator is not more than the above calculated torque value to control a discharge rate of the semi-solidified metal composition:

$$G = 4\pi r^2 L\omega\eta/(1-\alpha^2) \quad (2)$$

wherein G is a rotating torque, r is a radius of the agitator, L is a length of the agitator contacting with semi-solidified metal composition, $\omega$ is a rotating angular velocity of the agitator, $\eta$ is an indication value of fluidity represented by the above formula (1) and $\alpha$ is a ratio of radius of agitator to inner radius of the cooling agitation vessel.

In another preferable embodiments of the invention, the cooling agitation is repeatedly conducted at multi-stage vessels in which the solidification rate is gradually changed from a relatively large value to a small value, and molten metal is an aluminum alloy.

BRIEF DESCRIPTION OF THE DRAWINGS

The invention will be described with reference to the accompanying drawings, wherein.

DESCRIPTION OF THE PREFERRED EMBODIMENTS

Figure 1:
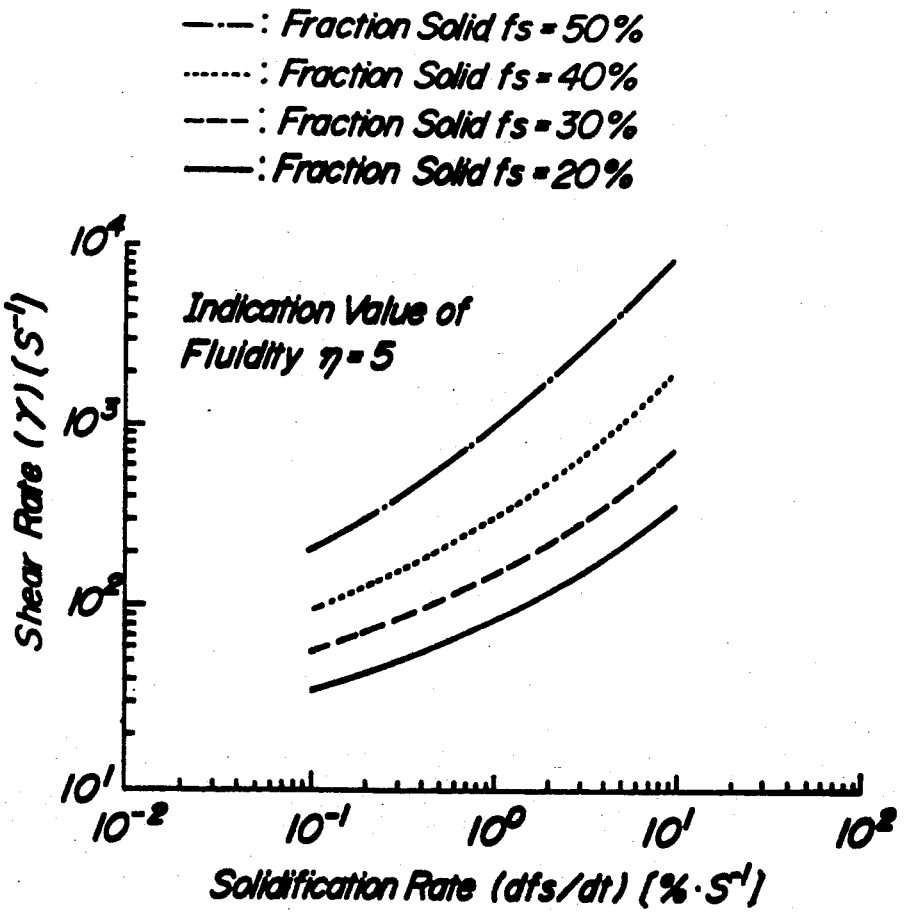
FIG. 1 is a graph showing a relation among solidification rate, shear rate and fraction solid for providing a constant fluidity of a slurry of semi-solidified metal composition.

The inventors have made experiments for the production of semi-solidified metal composition slurry using molten metals of various alloy compositions under various solidification rates and agitation conditions, and examined a relation of an indication value $\eta$ of fluidity of semi-solidified metal composition to liquid is limit fraction solid $f_{scr}$ showing a limit of fluidity, solidification rate R ($\%.\ s^{-1}$) and shear rate $\dot{\gamma}$ ($s^{-1}$) to obtain results as shown in FIG. 1. That is, the indication value of fluidity $\eta$ is a function for a fraction solid $f_s$, a liquidus limit fraction solid showing a limit of fluidity in the semi-solidified metal composition slurry (hereinafter referred to as limit fraction solid $f_{scr}$ simply) and a shape parameter a of crystal suspended in the semi-solidified metal composition. Further, $f_{scr}$ and a are functions for solidification rate R ($\%.s^{-1}$) below solidification starting temperature of molten metal (temperature of liquid phase line) and shear rate $\dot{\gamma}$, respectively. It has been found that they have the following relations:

$$\eta = a/2(1/f_s - 1/f_{scr}) \quad (1)$$

$$a = 35000.R^{0.5}.\dot{\gamma}^{-1.7}$$

$$f_{scr} = 0.65 - 1.4.R^{\frac{1}{3}}.\dot{\gamma}^{-\frac{1}{3}}$$

and the fluidity can stably be ensured when $\eta$ satisfies a relation of $\eta \leqq 10$.

In this case, $f_s$ is a fraction solid determined from equilibrium diagram based on the measured temperatures and has a relation of $f_{scr} > f_s$.

According to the above results, in the production of the semi-solidified metal composition slurry, the semi-solidified metal composition discharging into subsequent step after the cooling agitation is required to have a fluidity indication value $\eta$ of not more than 10, preferably not more than 5.

In order to ensure the desired fluidity of the semi-solidified metal composition discharged, therefore, the minimum shear rate is determined in accordance with the fraction solid and the solidification rate.

Moreover, the solidification rate is necessary to increase for making the fine grain size of crystal in the semi-solidified metal composition. However, as the solidification rate increases, the fluidity is degraded as mentioned above, so that it is necessarily required to increase the shear rate or to lower the fraction solid discharged.

When the semi-solidified metal composition having high fraction solid is produced by increasing the solidification rate to make the crystal grain size fine, therefore, high shear rate is necessary and it is preferable to use a multi-stage apparatus capable of providing high shear rate in which semi-solidified metal composition having a low fraction solid is produced at a high solidification rate in a first stage apparatus and then the fraction solid is increased at a low solidification rate in the subsequent stage apparatus, whereby semi-solidified metal composition having fine crystal grain size and high fraction solid can be obtained.

Figure 2:
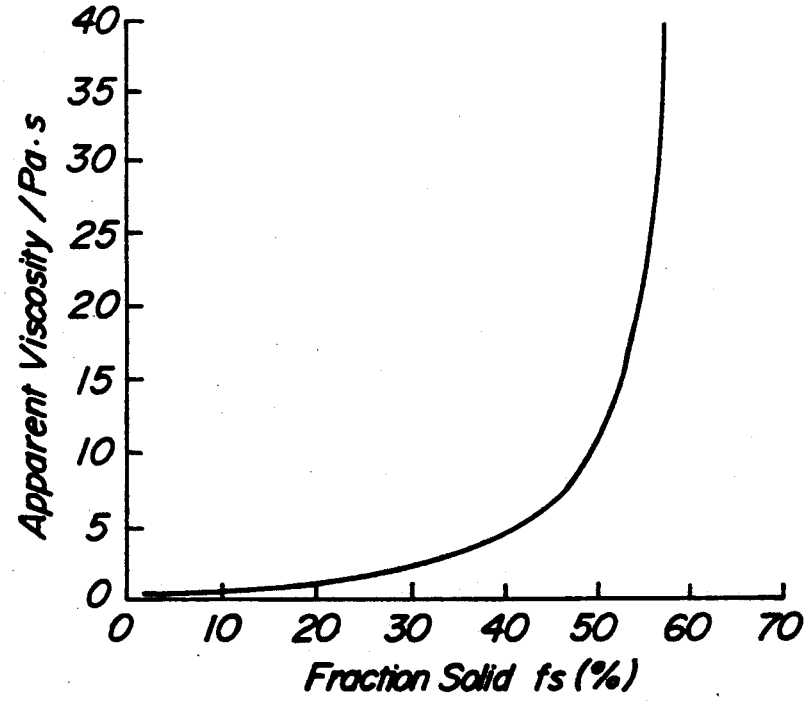
FIG. 2 is a graph showing a relation between fraction solid and apparent viscosity in semi-solidified metal composition.

In general, it is known that the apparent viscosity of the semi-solidified metal composition is most influenced by an amount of solid dispersed in the liquid matrix (fraction solid $f_s$) as shown in FIG. 2 and rapidly increases when the fraction solid exceeds a certain value.

On the other hand, the apparent viscosity of the dischargeable semi-solidified metal composition is naturally determined from characteristics inherent to the production apparatus such as cooling strength, shape of discharge nozzle and the like, from which it is apparent that the semi-solidified metal composition having a fraction solid higher than the dischargeable apparent viscosity can not be discharged. In this connection, according to the invention, the semi-solidified metal composition is stably discharged below the limit fraction solid while properly avoiding the rise of the fraction solid as mentioned later.

That is, the inventors have analyzed factors exerting upon the apparent viscosity of the semi-solidified metal composition and found that satisfactory result is obtained under the above fluidity indication value of the formula (1) by adjusting an opening degree of a discharge port in the cooling agitation vessel so that the agitator is rotated so as not to exceed a rotating torque G represented by the following formula (2):

$$G=4\pi r^2 L\omega\eta/(1-\alpha^2) \quad (2)$$

wherein r is a radius of the agitator, L is a length of the agitator contacting with semi-solidified metal composition, $\omega$ is a rotating angular velocity of the agitator, $\eta$ is an indication value of fluidity represented by the above formula (1) and $\alpha$ is a ratio of radius of agitator to inner radius of the cooling agitation vessel.

In the invention, if the production apparatus to be used is determined (i.e. the cooling rate is substantially determined) and the fraction solid of the semi-solidified metal composition to be discharged is determined, the fluidity indication value $\eta$ of the semi-solidified metal composition is determined from the formula (1), whereby the rotating torque G of the agitator can be calculated from the formula (2). By comparing the calculated rotating torque G with a rotating torque of the agitator measured by means of a torque detector attached to an agitating shaft of the cooling agitation vessel, the rotation of the agitator is controlled so that the measured rotating torque does not exceed the calculated rotating torque, whereby it is possible to stably discharge the semi-solidified metal composition having a given fraction solid.

Figure 3:
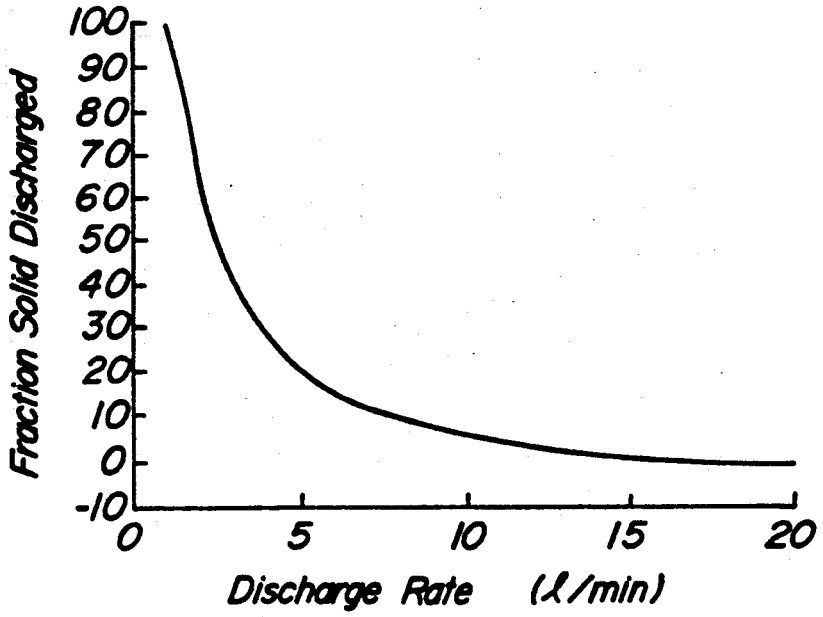
FIG. 3 is a graph showing a relation between discharge amount and fraction solid of semi-solidified metal composition.

As to the control of the above rotating torque, the inventors have found to be a relation as shown in FIG. 3. That is, the fraction solid of the semi-solidified metal composition discharged from the production apparatus is closely related to the discharge rate of semi-solidified metal composition so that the fraction solid of the semi-solidified metal composition can be changed by controlling the discharge rate and hence the rotating torque of the agitator can be changed as seen from the formulae (1) and (2). In fact, the opening degree of a slide valve arranged in the discharge port of the cooling agitation vessel is adjusted for changing the discharge rate.

Thus, it is possible to stably and continuously or discontinuously produce the semi-solidified metal composition having a given fraction solid selected within a range of low fraction solid to high fraction solid.

The following examples are given in illustration of the invention and are not intended as limitations thereof.

EXAMPLE 1

Figure 4:
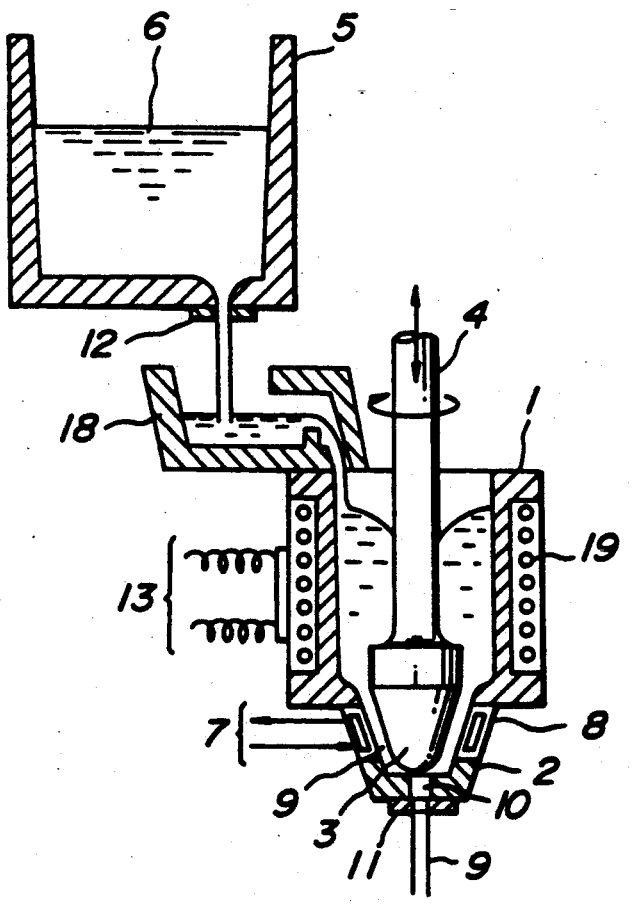
FIG. 4 is a schematic view of an apparatus for the continuous production of semi-solidified metal composition used in the invention.

Into an apparatus for the production of semi-solidified metal composition as shown in FIG. 4 was poured molten metal of Al-4.5% Cu alloy. Then, molten metal was cooled at an average cooling rate of 3.0%.s$^{-1}$ in a cooling agitation vessel while rotating an agitator at 600 rpm (shear rate=300/s) and the resulting semi-solidified metal composition was discharged out from a nozzle disposed in the bottom of the cooling agitation vessel. In this case, the temperature of the semi-solidified metal composition was continuously measured in the vicinity of the nozzle, from which the fraction solid was calculated to be 25% according to equilibrium diagram. That is, the semi-solidified metal composition could stably and continuously be produced and discharged to subsequent working device without causing the stop of the flowing.

EXAMPLE 2

Figure 5:
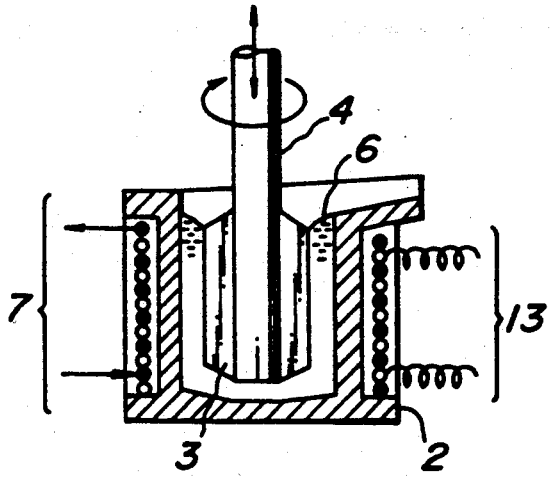
FIG. 5 is a schematic view of an apparatus for the discontinuous production of semi-solidified metal composition used in the invention.

Into an apparatus for the production of semi-solidified metal composition as shown in FIG. 5 was poured molten metal of Al-10% Cu alloy. Then, molten metal was cooled at an average cooling rate of 0.45%.s$^{-1}$ in a cooling agitation vessel while rotating an agitator at 600 rpm (shear rate=280/s), whereby the resulting semi-solidified metal composition having a good fluidity was discharged to have a fraction solid of 35% calculated from the temperature of the semi-solidified metal composition.

EXAMPLE 3

Figure 6:
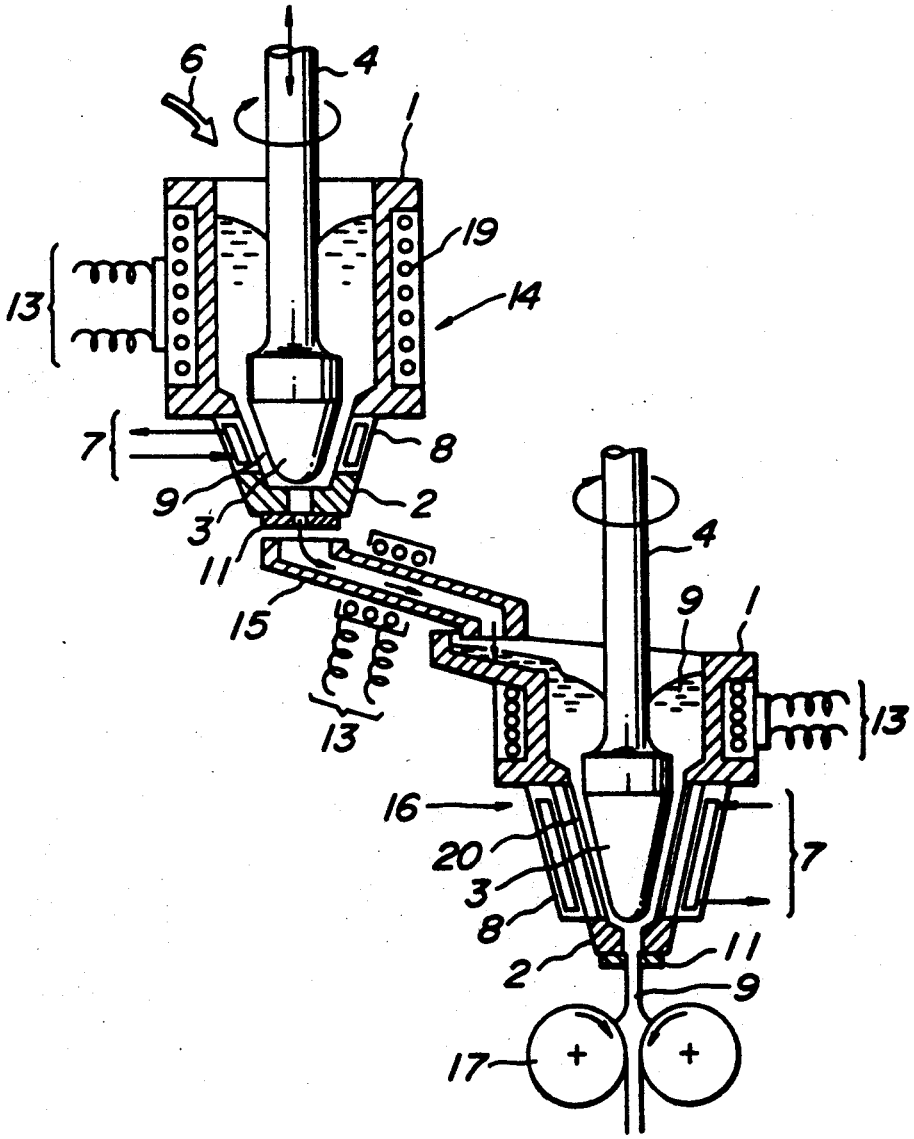
FIG. 6 is a schematic view of a multi-stage apparatus for the continuous production of semi-solidified metal composition having high fraction solid according to the invention.

Into an apparatus for the production of semi-solidified metal composition as shown in FIG. 6 was poured molten metal of Al-4.5% Cu alloy. Then, molten metal was cooled at an average cooling rate of 23.0%.s$^{-1}$ in a first stage of a cooling agitation vessel while rotating an agitator at 900 rpm (shear rate=450/s) to form a semi-solidified metal composition having a fraction solids of 11% calculated from the temperature of the composition at a nozzle of the first stage, which was transferred into a second stage of the apparatus and cooled at an average solidification rate of 0.20%.s$^{-1}$ to form a semi-solidified metal composition having a fraction solid of 47% calculated from the temperature of the composition at a nozzle of the second stage. In this way, the semi-solidified metal composition could continuously and stably be produced and discharged.

In FIGS. 4 to 6, numeral 1 is a temperature controlled vessel, numeral 2 a cooling agitation vessel, numeral 3 an agitator, numeral 4 a driving shaft, numeral 5 a ladle, numeral 6 molten metal to be poured, numeral 7 a cooling water, numeral 8 a water-cooled jacket, numeral 9 a slurry of semi-solidified metal composition, numeral 10 a thermocouple for the measurement of temperature, numeral 11 a discharge nozzle, numeral 12 a slide gate, numeral 13 an induction heating member, numeral 18 a tundish, and numeral 19 a heating coil. In FIG. 6, numeral 14 is a first stage device for the production of semi-solidified metal composition, numeral 15 a transferring pipe, numeral 16 a second stage device for the production of semi-solidified metal composition, numeral 17 a twin-roll casting machine, and numeral 20 a ceramic coating.

The control of solidification rate in the above examples was carried out by changing the material of the inner wall in the cooling agitation vessel, amount of cooling water, a clearance between the inner wall of the vessel and the agitator and the like.

The results of the above examples as well as the other examples are shown in Table 1.

TABLE 1

| Run No. | Alloy composition | Average solidification rate [% · s$^{-1}$] | Average shear rate [s$^{-1}$] | Average fraction solid discharged (%) | Indication value of fluidity $\eta$ | Average discharge rate [l/min] | Discharge time [min] | Apparatus |
|---|---|---|---|---|---|---|---|---|
| Example 1 | Al-4.5% Cu | 3.0 | 300 | 25 | 1.75 | 15 | 7 | FIG. 4 |
| Example 2 | Al-10% Cu | 0.45 | 280 | 35 | 1.11 | — | — | FIG. 5 |
| Example 3 | Al-4.5% Cu | first stage 23.0 second state 0.20 | 450 | first stage 11 second state 47 | first stage 1.92 second state 0.94 | 12 | 8 | FIG. 6 |
| Example 4 | Al-15% Cu | 0.14 | 150 | 38 | 2.01 | 13 | 8 | FIG. 4 |
| Example 5 | Cu-8% Sn | 0.3 | 300 | 43 | 1.72 | 10 | 10 | FIG. 4 |
| Comparative Example 1 | Al-4.5% Cu | 2.9 | 150 | 31 | $\infty$ ($f_s > f_{scr}$) | discharge impossible | — | FIG. 4 |
| Comparative Example 2 | Al-10% Cu | 4.0 | 450 | 42 | $\infty$ ($f_s > f_{scr}$) | discharge | — | FIG. 5 |

Figure 7:
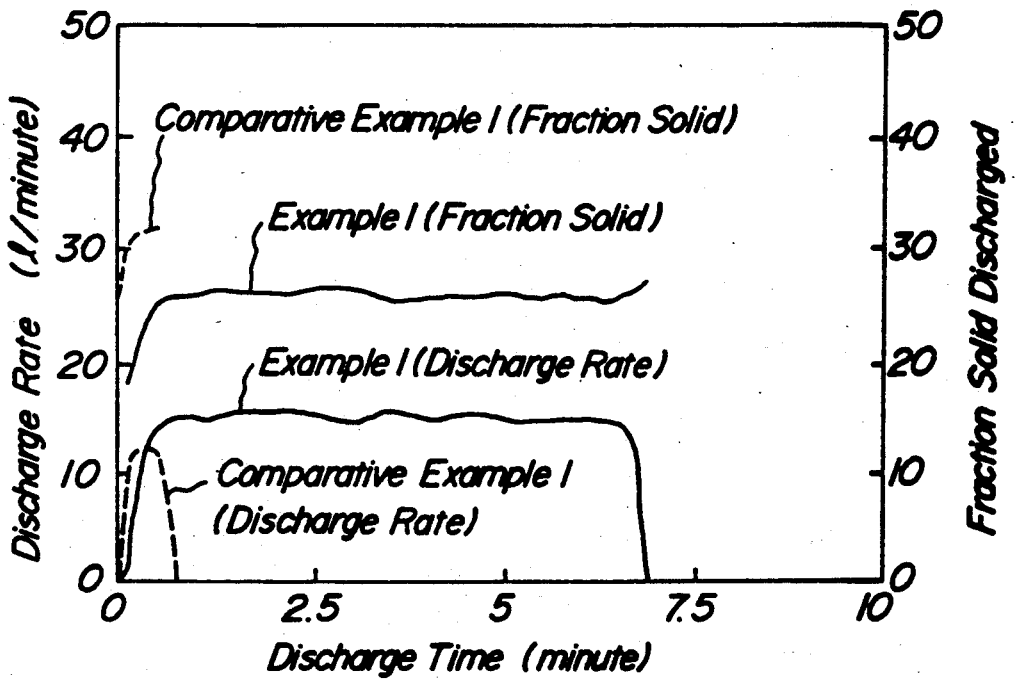
FIG. 7 is a graph showing a relation between discharge rate and fraction solid discharged with respect to discharge time in Example 1.

Furthermore, the change of discharge rate with the lapse of time in the production of the semi-solidified metal composition in Example 1 is shown in FIG. 7 together with that of Comparative Example 1. As seen from FIG. 7, the discharge rate is stable in Example 1, while the change of the discharge rate and the clogging of discharge port are caused in the course of the discharge in Comparative Example 1.

EXAMPLE 6

Figure 8:
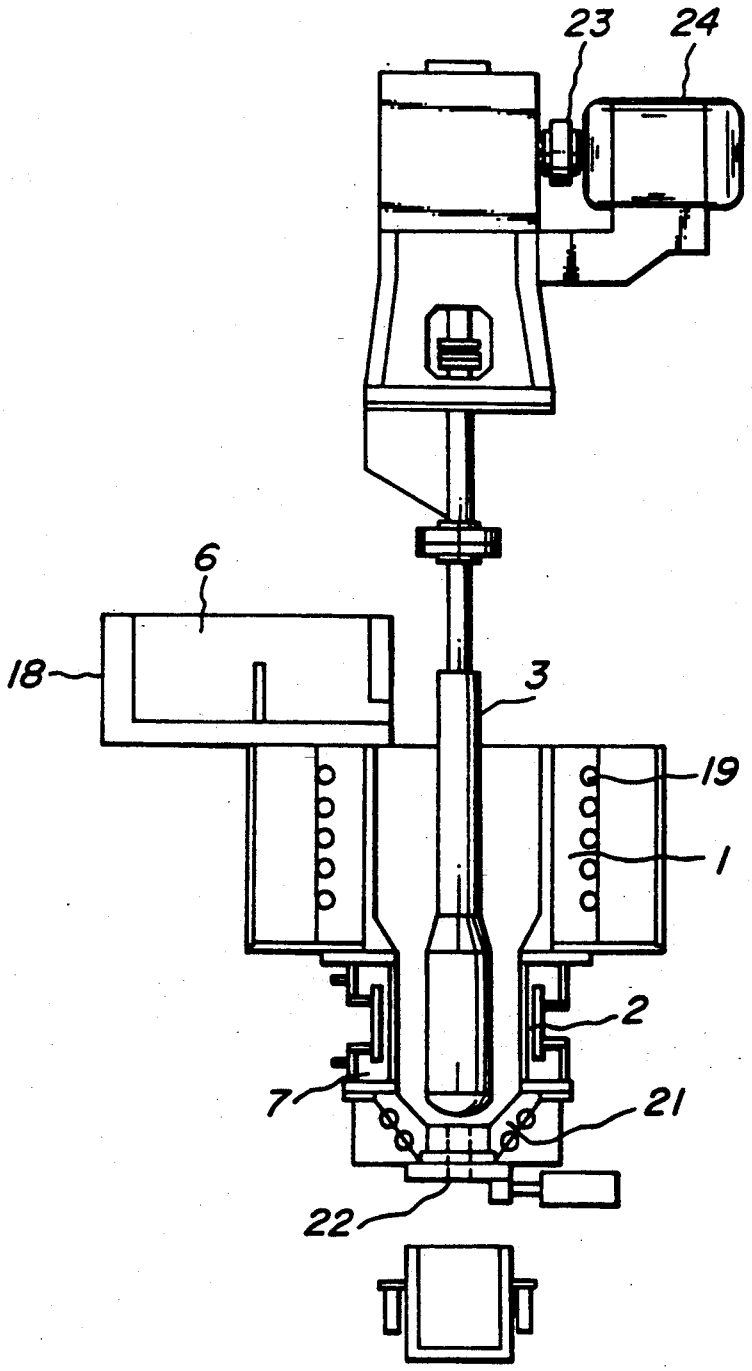
FIG. 8 is a schematic view of another apparatus for the production of semi-solidified metal composition according to the invention.

An apparatus for the production of semi-solidified metal composition as shown in FIG. 8 was used in this example, in which a cooling agitation vessel 2 conducting agitation with an agitator 3 and cooled with cooling water 7 was arranged at a lower part of a temperature controlled vessel 1 holding temperature of molten metal 6 poured through a tundish 18 and a discharge vessel 21 for discharging the resulting semi-solidified metal composition was arranged at a lower part of the vessel 2 and provided at its bottom with a slide valve 22 for controlling the discharge rate of the composition. Further, this apparatus was provided with a driving motor 24 for rotating the agitator 3 and a torque detector 23 attached to a shaft of the driving motor 24 for detecting the rotating torque of the agitator.

Figure 9:
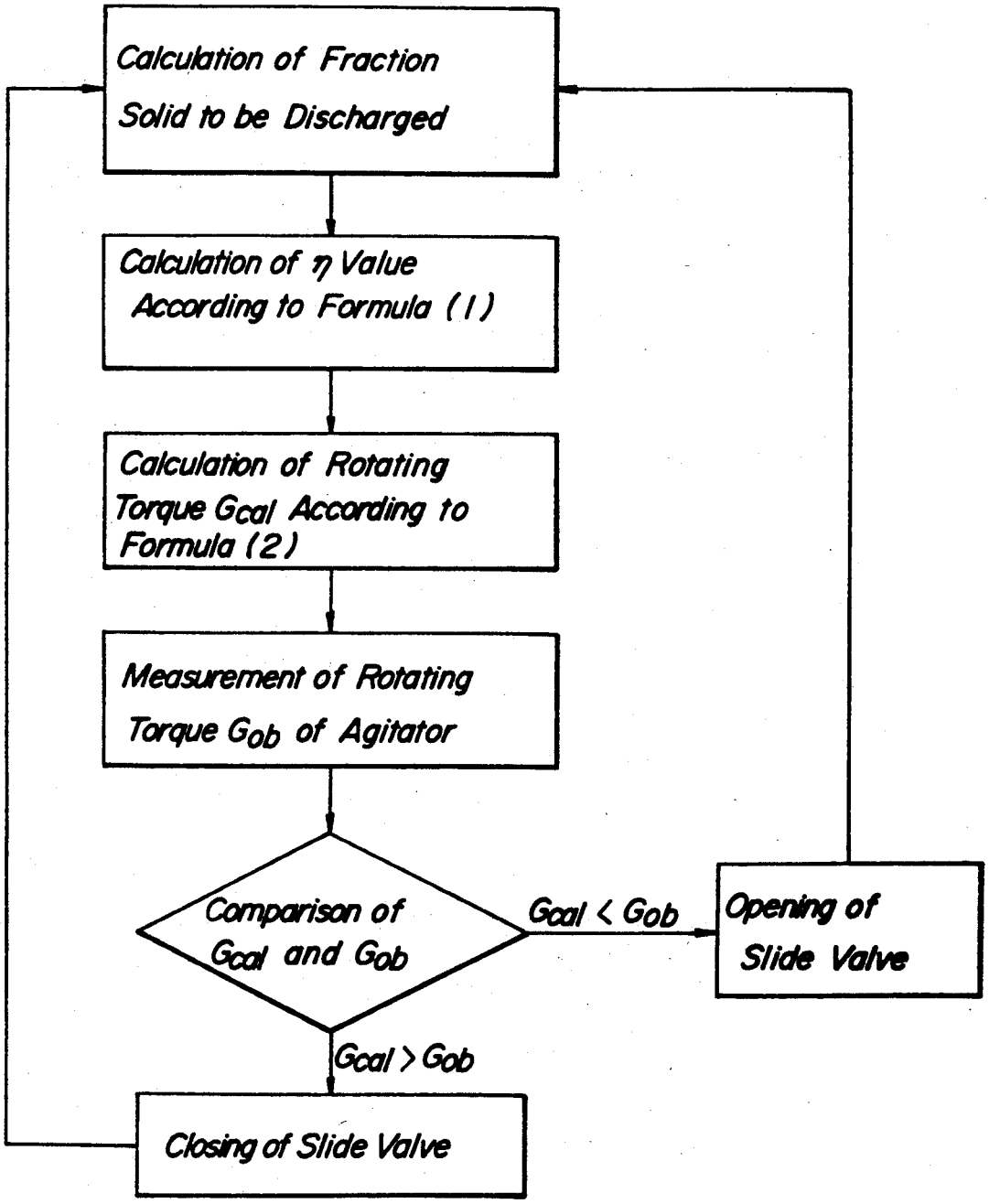
FIG. 9 is a flow chart of controlling opening degree of discharge valve according to the invention.

The control of the rotating torque was carried out according to a flow chart shown in FIG. 9. That is, the solidification rate was determined by measuring the temperature of the semi-solidified metal composition discharged, while the rotating torque $G_{cal}$ of the agitator was calculated from the formula (2) based on the given production condition of the semi-solidified metal composition of the formula (1). On the other hand, the torque value Gob Was actually measured from the torque detector 23 attached to the shaft of the driving motor 24 and then compared with the above value of Gcal. As a result, if $G_{ob}$ was larger than $G_{cal}$, the slide valve 22 was opened to increase the discharge rate of the semi-solidified metal composition, while if $G_{ob}$ was smaller than $G_{cal}$, the slide vale was closed to decrease the discharge rate. Thus, the semi-solidified metal composition having a target fraction solid of 20% could stably be discharged by repeating such a control every 1 second.

Figure 10:
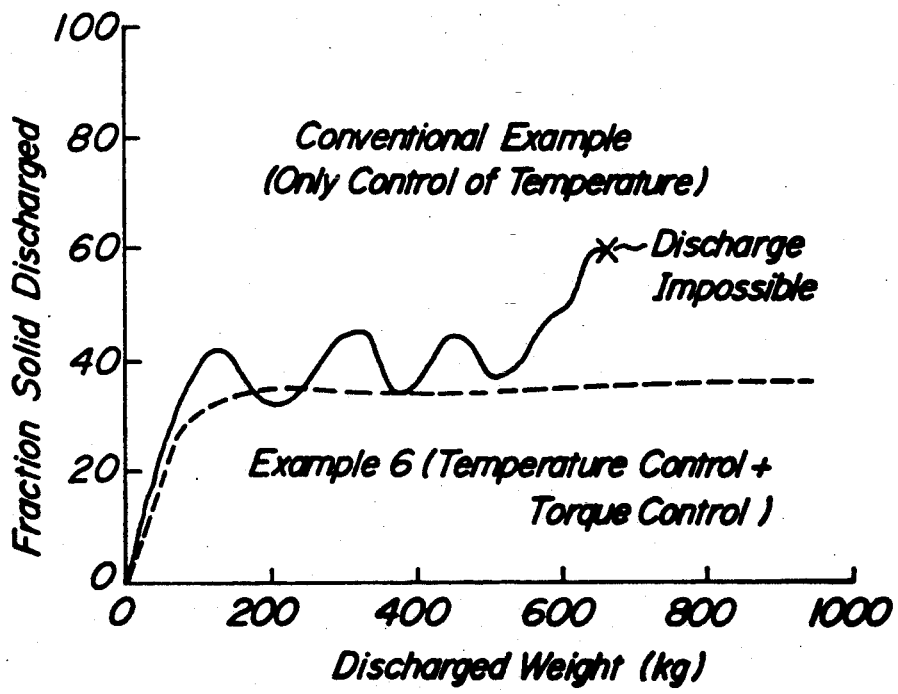
FIG. 10 is a graph showing a change of fraction solid in semi-solidified metal composition discharged in the invention.

In FIG. 10 is shown a change of fraction solid of the semi-solidified metal composition discharged in Example 6 together with that of the conventional example controlling the discharge of the semi-solidified metal composition only by measuring the temperature of the semi-solidified metal composition. In the conventional example, the fraction solid of the discharged semi-solidified metal composition considerably changes and finally the discharge in impossible. In Example 6, the fraction solid discharged is always stable.

As mentioned above, the invention develops the following effects.

(1) The semi-solidified metal composition can stably and continuously be produced and discharged even in an apparatus for producing semi-solidified metal compositions at a high solidification rate exhibiting poor fluidity and easily causing the clogging inside the apparatus.

(2) It is possible to stably and continuously produce semi-solidified metal compositions having a high fraction solid of, for example, 60%.

(3) The semi-solidified metal composition having a good fluidity can stably be produced even in an apparatus for discontinuously producing the semi-solidified metal composition.

(4) The stable operation is possible because the semi-solidified metal composition is transferred from the production apparatus into subsequent holding device, casting machine and working device without causing the clogging inside the apparatus.

(5) The starting of the operation is easy and the continuous operation over a long time is stable.

What is claimed is:

1. A process for stably producing semi-solidified metal compositions by pouring molten metal into a cooling agitation vessel, agitating it while cooling to produce a slurry of semi-solidified metal composition at a solid-liquid coexistent state and discharging out the semi-solidified metal composition from a discharge port of the vessel, characterized in that the cooling agitation is carried out so that a relation of fraction solid, solidification rate and shear rate satisfies the following equation (1)

$$\eta = a/2(1/f_s - 1/f_{scr}) \leqq 10 \quad (1)$$

wherein $\eta$ is an indication value of fluidity, $a = 35000.R^{0.5}.\dot{\gamma}^{-1.7}$, $f_s$ is fraction solid of the slurry of semi-solidified metal composition, $f_{scr} > f_s$, $f_{scr} = 0.65 - 1.4.R^{\frac{1}{2}}.\dot{\gamma}^{-\frac{1}{2}}$, R is an average solidification rate in the solidification of molten metal below solidification starting temperature (liquidus temperature) (%.s$^{-1}$) and $\dot{\gamma}$ is a shear rate (s$^{-1}$).

2. The process according to claim 1, wherein the cooling agitation operation is carried out by calculating an agitation torque acting to an agitator of the cooling agitation vessel from a given production condition of the semi-solidified metal composition according to the following formula (2) and adjusting an opening degree of the discharge port so that a torque measured from a torque detector disposed in a rotation driving system for the agitator is not more than the above calculated torque value to control a discharge rate of the semi-solidified metal composition:

$$G=4\pi r^2 L\omega\eta/(1-\alpha^2) \quad (2)$$

wherein G is a rotating torque, r is a radius of the agitator, L is a length of the agitator contacting with semi-solidified metal composition, $\omega$ is a rotating angular velocity of the agitator, $\eta$ is an indication value of fluidity represented by the above formula (1) and $\alpha$ is a ratio of radius of agitator to inner radius of the cooling agitation vessel.

3. The process according to claim 1, wherein the cooling agitation is repeatedly conducted at multi-stage vessels.

4. The process according to claim 3, wherein the solidification rate is gradually changed from a relatively large value to a small value in the multistage vessels.

5. The process according to claim 1, wherein said molten metal is an aluminum alloy.

* * * * *

UNITED STATES PATENT AND TRADEMARK OFFICE

CERTIFICATE OF CORRECTION

PATENT NO. : 5,144,998

DATED : September 8, 1992

INVENTOR(S) : Masazumi Hirai et al

It is certified that error appears in the above-identified patent and that said Letters Patent is hereby corrected as shown below:

In Column 8, at "Table 1", under the heading "Average discharge rate [l/min]", seventh line down, please change "discharge" to --discharge impossible --.

Signed and Sealed this

Twenty-ninth Day of June, 1993

Attest:

Michael K. Kirk

MICHAEL K. KIRK

Attesting Officer

Acting Commissioner of Patents and Trademarks